United States Patent [19]

Moshier

[11] Patent Number: 4,810,999

[45] Date of Patent: Mar. 7, 1989

[54] CONDUCTIVE FRANGIBLE GRILL ANTI-INTRUSION DEVICE

[76] Inventor: George A. Moshier, 430 Union Ave., Paterson, N.J. 07502

[21] Appl. No.: 805,696

[22] Filed: Dec. 6, 1985

[51] Int. Cl.[4] ..... G08B 13/08

[52] U.S. Cl. ..... 340/550; 49/50; 52/106; 52/456; 200/61.08; 200/61.93; 200/DIG. 12; 340/541

[58] Field of Search ..... 340/550, 665, 531, 652, 340/555–557, 815.31, 545, 541; 200/61.08, 154, 300, DIG. 2, 61.93; 160/10, 354, 371, 380; 52/456, 106; 49/50, 62

[56] References Cited

U.S. PATENT DOCUMENTS

| | | | |
|---|---|---|---|
| 1,578,980 | 3/1926 | Gasser . | |
| 2,043,207 | 6/1936 | Bayley et al. | 52/106 |
| 2,101,040 | 12/1937 | Bayley et al. | 52/106 |
| 2,374,139 | 4/1945 | Schriner . | |
| 3,051,935 | 8/1962 | Wilson . | |
| 3,474,587 | 10/1969 | Martin | 52/456 |
| 3,725,891 | 4/1973 | Miller . | |
| 3,936,621 | 2/1976 | Palin et al. . | |
| 4,232,310 | 11/1980 | Wilson | 200/61.08 |
| 4,399,430 | 8/1983 | Kitchen | 340/550 |
| 4,586,030 | 4/1986 | Klostermann | 340/550 |
| 4,652,472 | 3/1987 | Davies | 52/456 |

FOREIGN PATENT DOCUMENTS

| | | | |
|---|---|---|---|
| 4739472 | 4/1974 | Australia | 340/550 |
| 2098770A | 11/1982 | United Kingdom | 340/556 |

*Primary Examiner*—Joseph A. Orsino
*Assistant Examiner*—Brent A. Swarthout
*Attorney, Agent, or Firm*—Charles J. Brown

[57] ABSTRACT

An electrically conductive anti-intrusion device characterized by a free-standing grill of brittle frangible rods cantilevered across an opening to be protected, with a breakable electrical conductor within the rods, the rods and conductor being sufficiently fragile to snap upon an attempt to dislodge the grill, thereby generating an alarm.

3 Claims, 2 Drawing Sheets

CONDUCTIVE FRANGIBLE GRILL ANTI-INTRUSION DEVICE

BACKGROUND OF THE INVENTION

Alarm devices for preventing an intruder from entering a window or other aperture have had a long and full design history. They have included networks of electrical sensor wires disposed across window openings, protective screening with electrical circuitry included therein, optical fibers embedded in panes of glass or made into grills of fiber-optic rods and wires embedded in glass panes.

However grills of electrically conductive frangible rods, i.e. thin brittle rods which readily snap and generate an alarm if an intruder tries to dislodge or force his way by them, as hereafter described in reference to the present invention, are believed to be unknown in the prior art. Hollow rods or pipes with internal electrical conductors have been employed for burglar alarms as in U.S. Pat. No. 2,374,139 but they have been of metal to function as window bars as well as conductive alarms. In contrast to sturdy bars of that sort, easily broken or melted alarm-generating conductive strips of tinfoil or the like have been used but they have been applied directly to window panes as in U.S. Pat. No. 1,578,980. Frangible conductive elements for purposes other than burglar alarms are known, as for example the brittle electrical sensors of U.S. Pat. No. 3,936,621.

Perhaps the closest prior art to the invention is U.S. Pat. No. 3,725,891. While it discloses a grid of breakable plastic tubes containing a conductor, the tubes are mounted in a rigid frame and subframes, all of which must be sized to a particular window opening. The grid of tubes of this reference is therefor not free standing and cantilevered across the window opening, and indeed is a kind of open-mesh screen similar to protective alarm screens such as that of U.S. Pat. No. 3,051,935. In addition, the conductor within the tubes is an insulated wire which would require a rather considerable breaking force.

SUMMARY OF THE INVENTION

The invention provides an anti-intrusion device for an aperture defined by a peripheral member. The device comprises a free-standing, preferably unframed, grill of brittle frangible rods adapted to be mounted on the peripheral member to extend across the aperture. The rods are sufficiently fragile to readily break upon an attempt to manually dislodge them. A continuous breakable electrical conductor extends through certain of the frangible rods and forms part of a simple circuit interruptible upon breakage of the rods. An electrical power source is provided for energizing the circuit. Electrical signal means are included in the circuit to generate an alarm in response to an interruption in the circuit.

It is preferred that the conductor be a metallic deposit embedded within the rods which is not only breakable but is also meltable if subjected to flame. An elongated base may support the free-standing grill of frangible rods and a battery may be mounted in the base. The base is removably attachable to the aperture peripheral member in the preferred form of the invention and switch means in the circuit may be mounted on the base so that the circuit is interrupted when the base is removed from the peripheral member. The grill of frangible rods may be adjustably mounted on the base to be fixed in selected angular positions in the aperture.

DESCRIPTION OF THE PREFERRED EMBODIMENT

Figure 1:
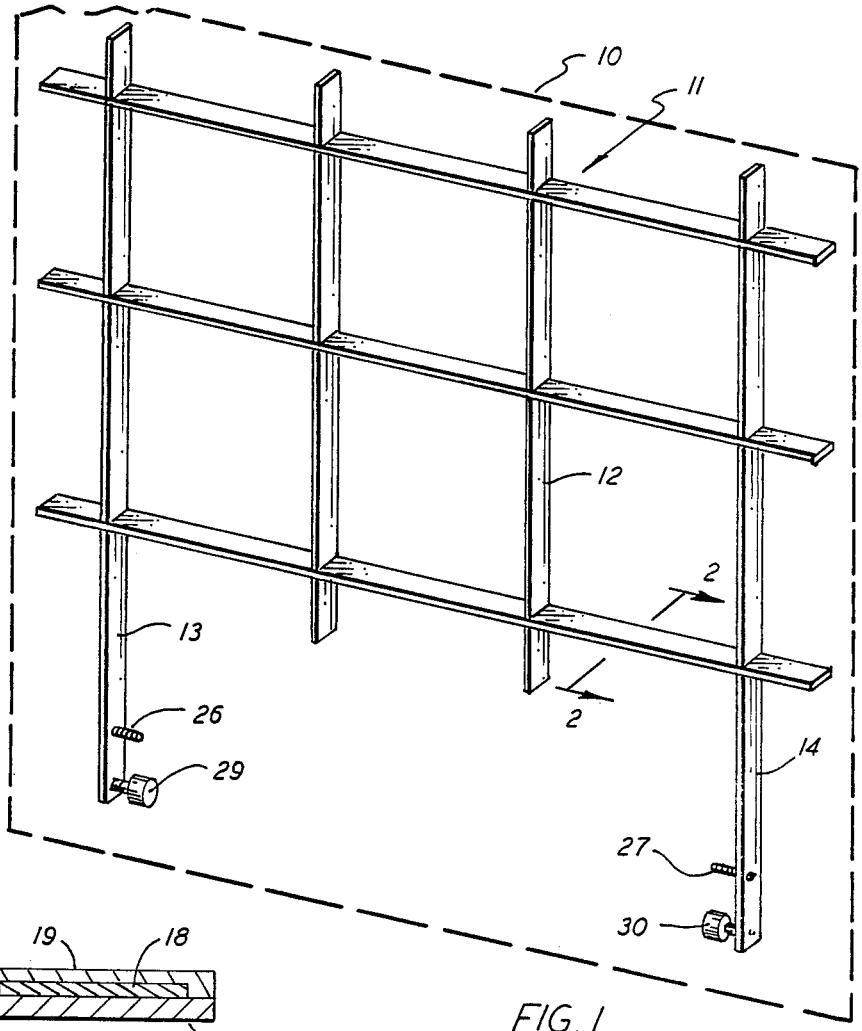
FIG. 1 is a perspective view of the free-standing grill of frangible rods of the invention, in relation to a window opening.

Referring first to FIG. 1 the rectangular dotted lines 10 schematically illustrate an aperture such as a window opening. The aperture 10 could also be a door or a duct or any other form of opening which is to be protected against intrusion. Within the aperture 10 is a grill 11 of frangible rods 12 shown here in a grid-type arrangement though other patterns, such as a simulated scroll or fan arrangement, could be employed as well. Certain of the rods 12 form downwardly extending legs 13 and 14, though it is to be understood that orientation with respect to ground is not important and the legs 13 and 14 could be horizontal and extending sidewardly or vertical and extending upwardly. In the usual window arrangement, however, the legs 13 and 14 extend downwardly towards an outwardly sloping sill 15 of a window as shown in FIG. 5.

Figure 2:
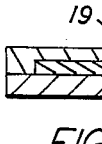
FIG. 2 is a section taken along the line 2—2 of FIG. 1.

By describing the rods 12 of the grill 11 as frangible it is intended to mean that they are readily breakable by anyone attempting to dislodge the grill 11 from the aperture 10. For this reason it is suggested that the rods 12 be of plastic, for example acrylic, and of a thin cross section as shown in FIG. 2 so that they can easily be snapped. Frangibility may be enhanced by notching the rods at appropriate places, such as at the legs 13 and 14, to minimize the force required to break them. At the same time, however, the rods 12 are rigid and self supporting so that they can be free-standing when cantilevered across the aperture 10. Typical dimensions may be one-eighth by one-half inch though it is to be understood that the cross section may be square or round or of any other shape. The cross section comprises a first plastic element 17 upon which a continuous microscopically thin conductive deposit 18 is applied to form an electrical conductor. The deposit may be metallic such as silver, or graphite, or other conductive deposit; in any event, it should not be a wire in the conventional sense because wires are not sufficiently frangible. Over the deposit 18 is secured a second plastic layer 19 so that the deposit is fully embedded within the plastic rod. The plastic used for the rod may be opaque so as to conceal the existence of the embedded conductor. Thermoplastic materials are particularly suitable so that if flame is applied to the grill 11 by an intruder with the intent of disabling the system the plastic will melt and so will the metallic coating 18. Any interruption in the continuity of the metallic coating 18 will cause an alarm to be generated as described below.

Figure 5:
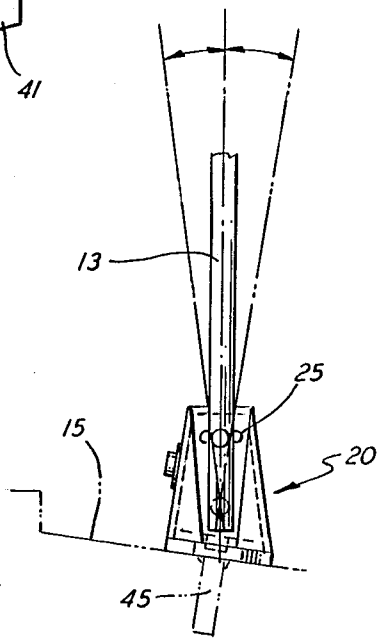
FIG. 5 is an end view of the base shown mounted on a sill.
Figure 4:
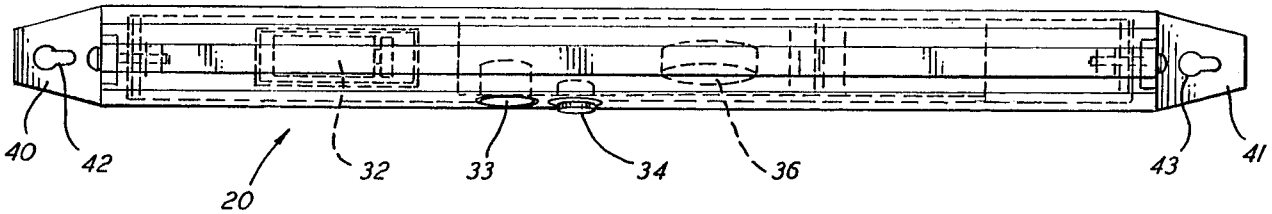
FIG. 4 is a plan view of the base of FIG. 3.
Figure 3:
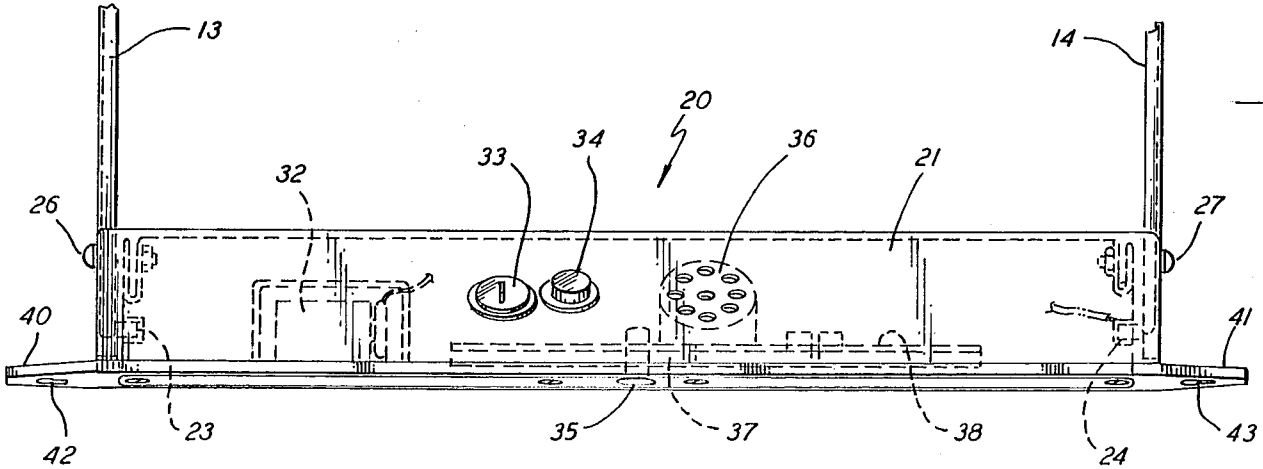
FIG. 3 is an elevation of the base supporting the rod grill of FIG. 1.

An elongated box-like base 20 supports the grill 11 as shown in FIGS. 3 to 5. It comprises an enclosed body 21 preferably molded of plastic. Coaxial pivot holes 23 and 24 are formed in the ends of the body 21 and above those holes are respective slots 25, one of which is visible in FIG. 5, for receiving adjustment screws 26 and 27 passing through the legs 13 and 14 of the grill 11. Trunnions 29 and 30 also extend from the legs 13 and 14 below the adjustment screws 26 and 27 as shown in FIG. 1 and fit within the respective holes 23 and 24 in the ends of the base body 21. The trunnions 29 and 30 also serve as electrical contacts and therefore they are to be of metal. The metallic deposit 18 or conductor which extends continuously throughout many portions of the grill within the rods 12 likewise extends down the legs 13 and 14 into electrical contact with the trunnions 29 and 30. Consequently when the trunnions are in place as shown in FIG. 3 an electrical circuit constituted by the continuous deposit 18 can be connected to electrical components within the base 20. Any attempt to remove the trunnions 29 and 30 and legs 13 and 14 from their illustrated position, wherein electrical contact is made with those components, will result in interruption of the circuit and activation of the alarm. These electrical components include a battery 32, typically of nine volt capacity, which fits into a recess on the underside of the base 20. The components further include a key-operated reset switch 33, a test switch 34, a reed switch 35, a buzzer 36, and a printed circuit board 37 of plug-in form. There also may be an optional transmitter 38 for activating a remote alarm, in which case the buzzer 36 would not be utilized. It is to be noted that the conductive deposit 18 may also extend continuously across the top of the base 20 to insure that the alarm will be activated in the event an intruder attempts to break the base 20 itself.

Mounting flanges 40 and 41, having bayonet-type screw holes 42 and 43, extend outwardly from opposite ends of the body 21 of the base 20. Wood screws may be inserted through the holes 42 and 43 to fix the base 20 in place on the window sill 15. As shown in FIG. 5, the bottom of the base 20 is angled slightly to accommodate the typical outward and downward pitch of a sill. The adjustment screws 26 and 27 operable within the slots 25 allow the grill 11 to be located perpendicular to ground with some adjustment for individual sill slopes, all within a range of approximately fifteen degrees as shown in FIG. 5. The reed switch 35 is then located directly over a magnet 45 embedded in the sill 15. By the circuitry described below it will be understood that the reed switch will cause an alarm to sound when it is removed from the influenece of the magnet 45.

Figure 6:
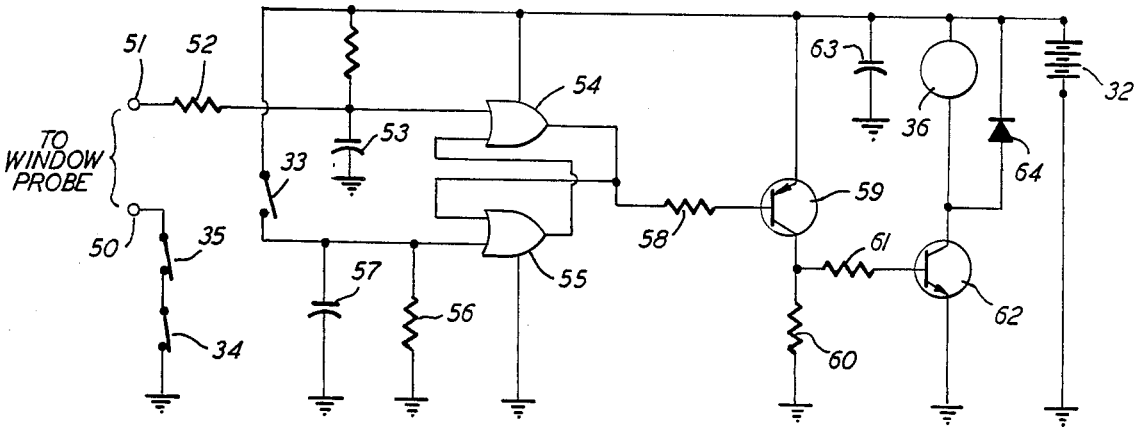
FIG. 6 is a circuit diagram showing the electrical components of the device.

The electrical circuitry of the invention is not critical and may be varied, though one suitable circuit is shown in FIG. 6. Contacts 50 and 51 correspond to the trunnions 29 and 30. Contact 51 is connected to a one-half watt resistor 52, a ceramic capacitor 53 and a quad gate 54. A second quad gate 55 also is included as shown, connected to ground by a resistor 56 and a capacitor 57. A resistor 58 is provided together with a tansistor 59, resistors 60 and 61 and a second transistor 62. A capacitor 63 is incorporated as shown along with a diode 64.

The reset switch 33 of FIGS. 3 and 4 is shown in the circuit diagram of FIG. 6 together with the reed switch 35 and the test switch 34. The battery 32 is shown in the circuit as is the buzzer 36.

By this circuitry the device is self-protected in that its reed switch 35 is in closed position when the base 20 is installed on the sill 15 containing the magnet 45. If the base 20 is removed from the sill 15 the switch will open causing the alarm buzzer 36 to sound. The alarm will also sound if the metallic deposit 18 is interrupted on the rods 12 whether by breakage of the rods or by melting of the deposit 18 and the plastic surrounding it.

Unlike many burglar alarm systems of the prior art, the device of the invention is mounted independently of the window pane or screen in the aperture. Therefore a window and screen may be opened or closed for ventilation control without regard to the continued operation of the invention. Also the grill of the invention is free-standing and unframed so that it need not be sized to a particular window opening. It serves as a stock device suitable, within limits, to windows of various size.

The scope of the invention is to be determined from the following claims rather than the foregoing preferred embodiment.

I claim:

1. An anti-intrusion device for and aperture defined by a peripheral member comprising (a) a free-standing grill of rigid, brittle, frangible rods adapted to be cantilevered on the peripheral member to extend across the aperture and being sufficiently fragile to readily snap upon an attempt to manually dislodge them, (b) a continuous breakable electrically conductive deposit fully embedded within and electrically insulated by the frangible rods and forming part of a single circuit interruptible upon snapping of the rods where the conductive deposit is embedded, (c) an electrical power source for energizing said circuit, and (d) electrical signal means in said circuit adapted to generate an alarm in response to interruption of said circuit.

2. An anti-intrusion device according to claim 1 wherein the conductor is a metallic deposit embedded within the rods, the deposit being both breakable and meltable if subjected to flame.

3. An anti-intrusion device for a window opening having a sill comprising (a) a free-standing grill of rigid, brittle, frangible rods and being sufficiently fragile to readily snap upon an attempt to manually dislodge them, (b) an elongated base supporting the grill of frangible rods and adapted to be removably mounted on the sill so that the grill is cantilevered across the window opening, (c) a continuous breakable electrical conductor in the form of a metallic deposit fully embedded within the frangible rods and electrically insulated thereby and forming part of a single circuit interruptible upon snapping of the rods where the conductive deposit is embedded, (d) the metallic deposit also being adapted to melt and interrupt the circuit if subjected to flame, (e) switch means in the circuit mounted on the base so that the circuit is interrupted when the base is removed from the sill, (f) a battery in the base for energizing said circuit, (g) the grill of frangible rods being adjustably mounted on the base to be fixed in selected angular positions with respect to said window opening, and (h) electrical audible signal means mounted in said base adapted to generate an alarm in response to an interruption in said circuit.

* * * * *